US006317984B1

(12) United States Patent
Okabe

(10) Patent No.: US 6,317,984 B1
(45) **Date of Patent: *Nov. 20, 2001**

(54) INNER CUTTER FOR A RECIPROCATING ELECTRIC SHAVER AND RECIPROCATING ELECTRIC SHAVER

(75) Inventor: Masaki Okabe, Matsumoto (JP)

(73) Assignee: Izumi Products Company, Nagano (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,107

(22) Filed: Sep. 8, 1999

(51) Int. Cl.[7] ..... B26B 19/04
(52) U.S. Cl. ..... 30/43.92; 30/346.51
(58) Field of Search ..... 30/43.92, 346.51, 30/43.9, 43.91

(56) References Cited

U.S. PATENT DOCUMENTS 4,030,573 * 6/1977 Buzzi et al. ..... 30/43.92 X
5,611,145 * 3/1997 Wetzel et al. ..... 30/43.92

FOREIGN PATENT DOCUMENTS

2035346 * 1/1971 (DE) ..... 30/345.51

* cited by examiner

*Primary Examiner*—Douglas D. Watts
(74) *Attorney, Agent, or Firm*—Koda & Androlia

(57) ABSTRACT

An inner cutter being used for a reciprocating electric shaver and comprised of a pair of supporting wall sections that are disposed opposite to each other and small cutters that have an inverted U cross-sectional shape and are disposed between the upper ends of the pair of supporting wall sections in a plurality of numbers so as to be arranged along the direction of length of the supporting wall sections; and in this inner cutter, only the small cutters are disposed between the pair of supporting wall sections.

9 Claims, 10 Drawing Sheets

INNER CUTTER FOR A RECIPROCATING ELECTRIC SHAVER AND RECIPROCATING ELECTRIC SHAVER

BACKGROUND OF THE INVENTION

1. Field of the Invention

The present invention relates to an inner cutter for a reciprocating electric shaver and a reciprocating electric shaver that uses such an inner cutter.

2. Prior Art

A conventional inner cutter for a reciprocating electric shaver will be described first.

The overall structure of an ordinary reciprocating electric shaver will be described with reference to FIG. 19.

The electric shaver 10 is comprised of: a mesh-form outer cutter 12 which is formed using a thin metal plate and has openings in the form of eyes of mesh, a holding frame 14 which holds this outer cutter 12 in a bent state, an inner cutter 16 which shaves whiskers by performing a reciprocating motion while contacting the inner surface of the outer cutter 12, a main body case 24 which contains therein a power supply (a battery in this example) 18 and an electric motor 20 and which has an on-off switch 22 provided on its outer surface, and a driving mechanism 28 which is disposed on the upper surface of the main body case 24 and causes the inner cutter 16 to make a reciprocating motion by converting the rotational motion of the output shaft 26 of the electric motor 20 into a linear motion. The holding frame 14 is removably attached to the upper surface of the main body case 24, and it covers the inner cutter 16 while bending and holding the outer cutter 12. The attachment and detachment mechanism for this holding frame 14 is obtained from, for example, hooks 30 installed on both side surfaces of the holding frame 14 so that they are engaged with engaging grooves 32 formed in both sides of the upper surface of the main body case 24.

Next, the structure of the inner cutter 16 will be described in detail.

The inner cutter 16 consists of a pair of supporting wall sections 16*a*, which are disposed so as to face each other, and a plurality of small cutters 16*b*,which have an inverted U cross-sectional shape and are disposed side by side along the direction of length of the supporting wall sections 16*a* between the upper ends of the supporting wall sections 16*a*.

The inner cutter 16 is manufactured by, for instance, the following manner: a metal plate is bent into an inverted U cross-sectional shape, and a plurality of slits 16*c* which cut across the direction of length A of the bent portion B of the metal plate are formed at intervals in this bent portion B. The areas with an inverted U shape that remain in the bent portion B after such a cutting form the small cutters 16*b*. Also, a pair of extended portions C positioned at the bent tip ends of the metal plate, i. e, the portions other than the bent portion, form a pair of supporting wall sections 16*a* that face each other.

To the pair of supporting wall sections 16*a* of the inner cutter 16, connecting pins 34, a connecting block 40, etc. are attached, so that the pair of supporting wall sections 16*a* are connected to each other. More specifically, as shown in FIG. 19, the connecting pins 34 are attached to the pair of supporting wall sections 16*a* of the inner cutter 16 so as to maintain the shape of the inner cutter 16 as an inverted U cross-sectional shape. Also, as shown in FIG. 20, the connecting block 40 is made of a synthetic resin and has a slit 38 formed in its lower surface so that the slit 38 engages an eccentric pin 36 which is coupled to the output shaft 26 of the electric motor 20 and forms a part of the driving mechanism 28.

However, the following problems arise in the above-described conventional inner cutter for a reciprocating electric shaver:

The shaved whiskers enter the interior of the inverted-U-shaped inner cutter 16 and accumulate on the upper surface of the main body case 24.

When these whiskers are to be cleaned away, the whiskers that have accumulated on the upper surface of the main body case 24 must be swept away by a brush, etc. In addition, since whiskers also adhere to the inner surfaces of the inner cutter 16, i. e., they adhere to the inner surfaces of the small cutters 16*b* and to the facing inner surfaces of the pair of supporting wall sections 16*a*, these adhering whiskers must be swept away by a brush.

However, the above-described connecting pins 34 and connecting block 40 attached between the pair of supporting wall sections 16*a* of the inner cutter 16 constitute an obstacle, and the brush cannot be moved along the supporting wall sections 16*a*. Accordingly, cleaning of the inner surfaces of the small cutters 16*b* and the facing inner surfaces of the pair of supporting wall sections 16*a* by a brush is difficult, and considerable time is required for such cleaning.

SUMMARY OF THE INVENTION

Accordingly, the present invention is devised so as to solve the above-described problems. The object of the present invention is to provide an inner cutter for a reciprocating electric shaver and a reciprocating electric shaver which allows easy cleaning of the interior of the inner cutter.

In order to accomplish the above-described object, the inner cutter according to the present invention is for a reciprocating electric shaver wherein the inner cutter is comprised of a pair of supporting wall sections that are disposed opposite to each other, and small cutters with an inverted U cross-sectional shape which are disposed between the upper ends of the pair of supporting wall sections so as to be along the direction of length of the supporting wall sections; and the inner cutter of the present invention is characterized in that only the small cutters are disposed between the pair of supporting wall sections.

In this structure, when whiskers adhering to the inner surface of the inner cutter, i. e., the inner surfaces of the small cutters and the facing inner surfaces of the pair of supporting wall sections, are to be cleaned away by a brush, cleaning can be continuously accomplished from one end to the other while the brush is freely moved through the interior space of the inner cutter which has a bent external shape overall. Accordingly, cleaning is easily and reliably accomplished for places which are difficult to reach with the brush as a result of interference by the connecting pins and connecting block in cases where such connecting pins and connecting block are provided as in conventional devices.

Furthermore, the concrete structure of the inner cutter is as follows: the pair of supporting wall sections are formed by a pair of oppositely extended portions of a metal plate which is bent in two so that the bent portion of the metal plate has an inverted U shape in cross section, and the small cutters are formed by opening a plurality of slits that cut across the direction of length of the bent portion at intervals in the bent portion.

Furthermore, the inner cutter according to the present invention is for a reciprocating electric shaver wherein the inner cutter is comprised of a pair of supporting wall sections that are disposed opposite to each other, and small cutters with an inverted U cross-sectional shape which are disposed between the upper ends of the pair of supporting wall sections and being disposed along the direction of length of the supporting wall sections; and in the present invention, only the small cutters and connecting arches which are formed with the same cross-sectional shape as the small cutters are disposed side by side between the pair of supporting wall sections.

In this structure, the connecting arches are disposed between the pair of supporting wall sections in addition to the small cutters. Accordingly, the strength of the inner cutter as a whole is improved compared to the inner cutter with only the small cutters provided.

Furthermore, the pair of supporting wall sections and connecting arches can be integrally molded using a synthetic resin material, and the small cutters are attached between the pair of supporting wall sections by insert molding. With this structure, manufacture can easily be accomplished, and the strength of the inner cutter as a whole is improved.

Furthermore, in the above-described inner cutter for a reciprocating electric shaver, it is possible the chamfer the corners of the inner surfaces of the small cutters that have no connection with the cutting of whiskers by the inner and outer cutters. As a result, the brush is prevented from being caught by the chamfered corners, and cleaning can be accomplished smoothly.

Furthermore, the reciprocating electric shaver according to the present invention is characterized m that the shaver is equipped with the above-described inner cutter, a mesh-form outer cutter bent in an inverted U cross-sectional shape so that its inner surface contacts the outer surface of the inner cutter, and a driving mechanism provided so as to cause the inner cutter to perform a reciprocating motion relative to the mesh-form outer cutter along the direction of length of the supporting wall sections.

With this structure, it is possible to provide a reciprocating electric shaver in which whiskers adhering to the inner cutter can easily be cleaned away.

DETAILED DESCRIPTION OF THE PREFERRED EMBODIMENTS

Figure 1:
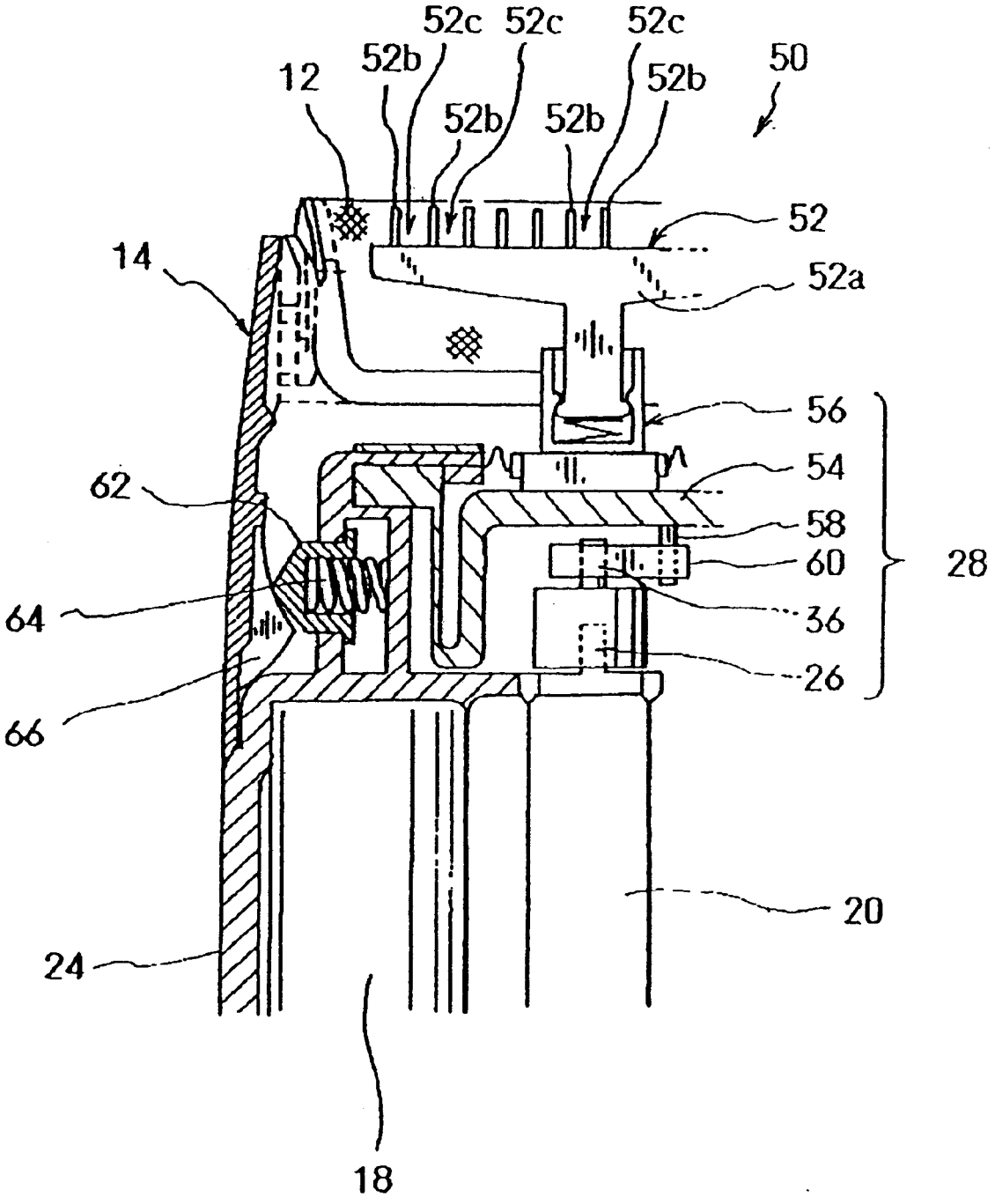
FIG. 1 is an enlarged sectional view showing a part of the structure of an electric shaver which has the inner cutter for a reciprocating electric shaver according to the present invention.

Below, a preferred embodiment of the inner cutter for a reciprocating electric shaver of the present invention will be described in detail with reference to the accompanying drawings. Constituting elements which are the same as in the above-described conventional example are labeled with the same reference numerals, and a detailed description of such elements is omitted.

First Embodiment

First, an outline of the overall structure of the reciprocating electric shaver 50 will be described with reference to FIG. 1.

The electric shaver 50 comprises: a mesh-form outer cutter 12 which is formed from a thin metal plate and has openings in the form of eyes of a mesh; a holding frame 14 which holds this outer cutter 12 in a bent state; an inner cutter 52 which shaves whiskers by making a reciprocating motion while contacting the inner surface of the outer cutter 12; a main body case 24 which contains a battery 18 (a power source) and electric motor 20, etc. and has an on-off switch (not shown) mounted on its outer surface; and a driving mechanism 28 which protrudes from the upper surface of the main body case 24, connects the output shaft 26 of the electric motor 20 and the inner cutter 52, and converts the rotational motion of the electric motor 20 into a reciprocating motion for the inner cutter 52.

The holding frame 14 is removably attached to the upper surface of the main body case 24, so that the holding frame 14 covers the inner cutter 52 while bending and holding the outer cutter 12.

Various structures may be used for the driving mechanism 28. In one example used in this embodiment, the driving mechanism 28 is constructed from a vibrator 54, a connecting base 56 which is installed on the upper surface of the vibrator 54 and to which the inner cutter 52 is connected, and a likmg member 60 which connects a first shaft 58 installed on the undersurface of the vibrator 54 with an eccentric pin 36 attached to the output shaft 26 of the electric motor 20. In this structure, the rotational motion of the output shaft 26 is converted into a reciprocating linear motion of the vibrator 54 via the liking member 60.

Various structures may also be employed for the removing mechanism for removably attaching the holding fame 14 (to which the outer cutter 12 is attached) to the main body case 24. One example is shown in FIG. 1. In this mechanism, an engaging element 62 is attached so as to freely protrude and retract in the lateral direction along the side surface of the Upper Portion of the main body case 24, and a spring 64 is provided so as to constantly drive this engaging element 62 in the direction of protrusion; and an engaging projection 66 that engages with the engaging element 62 is provided on the inner surface of the holding frame 14

In this removing mechanism, when the holding frame 14 is press-fitted in the main body case 24 at the time that the holding frame 14 is mounted, the engaging projection 66 rides over the engaging element 62 while pushing the engaging element 62 into the main body case 24 against the driving force of the spring 64. The engaging projection 66 then engages with the engaging element 62, so that mounting is completed. The mounted holding frame 14 cannot easily be detached from the main body case 24 since the engaging element 62 protrude due to the driving force of the spring 64.

The holding frame 14 is detached from the main body case 24 as follows: the holding frame 14 is conversely pulled in the non-engagement direction, this causes the engaging projection 66 to ride over the engaging element 62 while pushing the engaging element 62 into the main body case 24 against the force of the spring 64, and the holding frame 14 can be removed accordingly.

Figure 2:
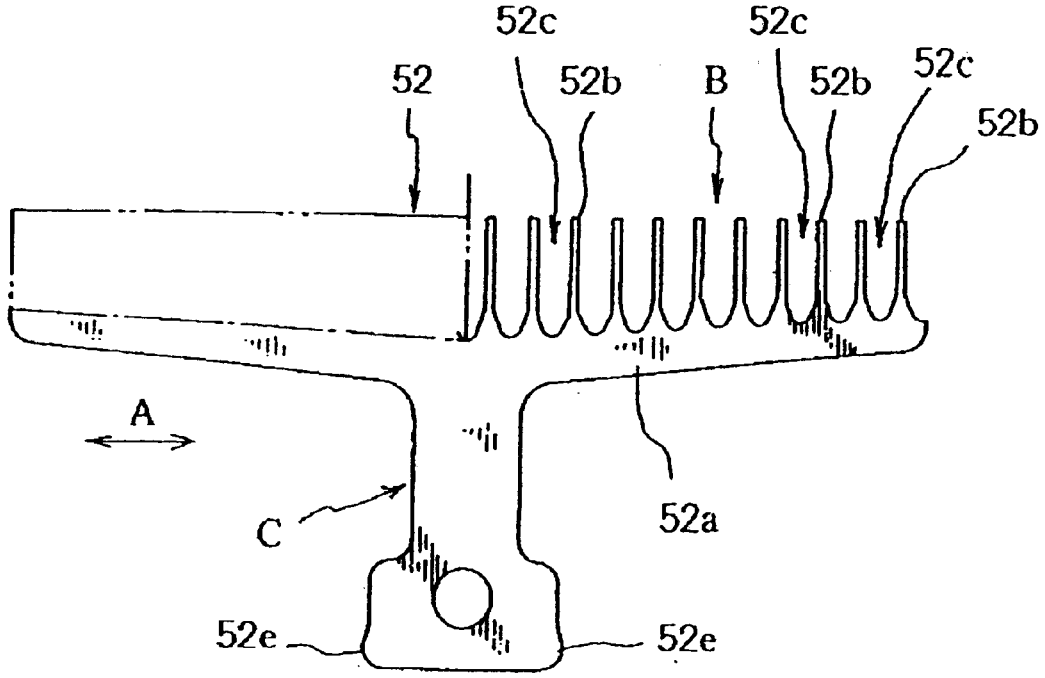
FIG. 2 is a front view which shows the structure of a first embodiment of the inner cutter for a reciprocating electric shaver according to the present invention.

Next, a detailed structure of the inner cutter 52, which is the characterizing feature of the present invention, will be described with reference to FIGS. 2 and 3.

The inner cutter 52 consists of a pair of supporting wall sections 52*a* (which is T-shaped in this embodiment), and a plurality of small cutters 52 with an inverted U cross-sectional shape. The plurality of small cutters 52 are disposed between the upper ends of the supporting wall sections 52*a* and are lined up side by side along the direction of length A of the supporting wall sections 52*a*. The method for manufacturing this inner cutter 52 is similar to the method used in the prior art inner cutter: a metal plate is bent into an inverted U cross-sectional shape, and a plurality of slits 52*c* which cut across the direction of length A of the bent portion B are formed at intervals (fixed intervals in FIG. 2) in the bent portion B, so that the inverted-U-shaped thin parts that remain in the bent portion 13 form the small cutters 52*b*. The pair of extended portions C positioned at the bent tip ends of the metal plate are formed as the pair of supporting wall sections 52*a*.

The slits 52*c* may be oriented in the direction perpendicular to the direction of length A of the bent portion B. Alternatively, the slits 52*c* may be formed at a slightly oblique angle with respect to the direction perpendicular to the direction of length A of the bent portion B.

Figure 3:
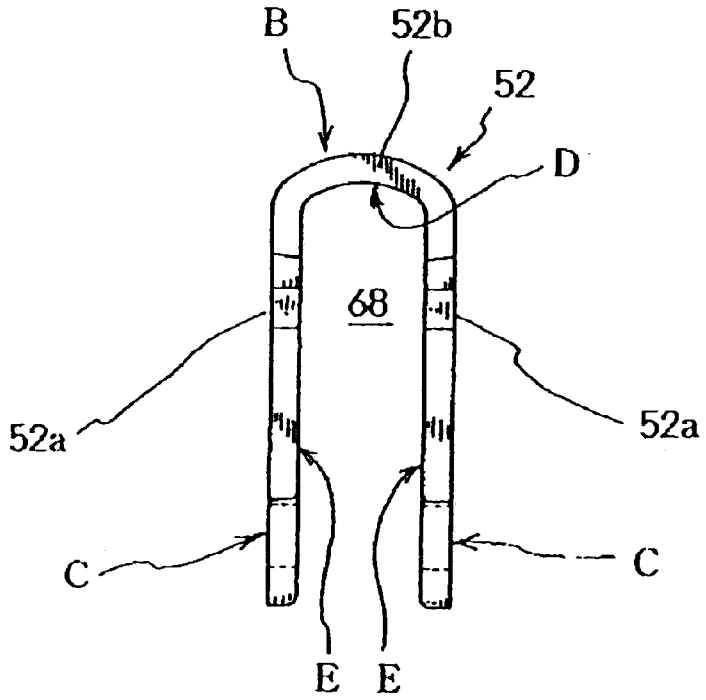
FIG. 3 is a side view of FIG. 2.
Figure 4:
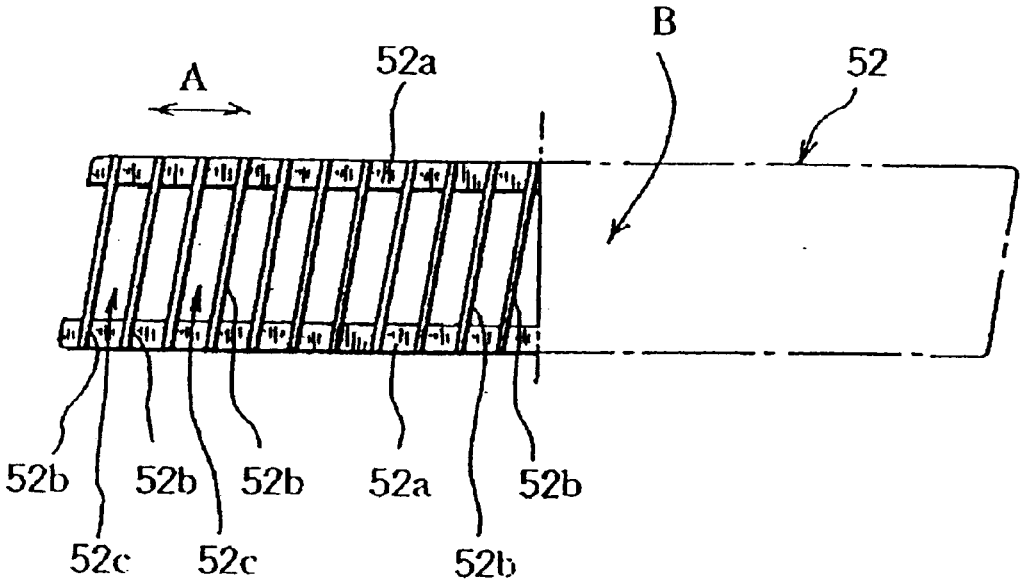
FIG. 4 is a plan view illustrating a case in which the slits and small cutters shown in FIG. 2 are formed at an oblique angle.

Here, the difference between the inner cutter 52 of the present invention and the prior art inner cutter 16 is that except for the small cutters 52*b*, no members which span the gap between the supporting wall sections 52*a* of the inner cutter 52, such as the connecting pins 34, connecting block 40, etc. used in the prior art inner cutter 16, are provided on the supporting wall sections 52*a* of the inner cutter of the present invention (as shown in FIG. 3).

Since the inner cutter 52 has the structure as described above, when whiskers adhering to the inner surface of the inner cutter 52, i. e., the inner surfaces D of the small cutters 52*b* and the facing inner surfaces E of the pair of supporting wall sections 52*a*,are to be cleaned away by a brush, the user can continuously clean the inner cutter 52 from one end to the other while freely moving the cleaning brush in the internal space 68 of the inner cutter 52, which has a bent shape as a whole. Accordingly, inside positions, which are difficult to reach when the connecting block 40 and connecting pins 34 are present (as in the prior art inner cutter) because of the interference of such elements with the brush, can be easily and securely cleaned.

SECOND EMBODIMENT

In the inner cutter 52 of the above-described embodiment, only the small cutters 52*b* are disposed between the pair of supporting wall sections 52*a*. However, the inner cutter 52 having the structure as shown in FIGS. 5 and 6 is also possible.

Figure 5:
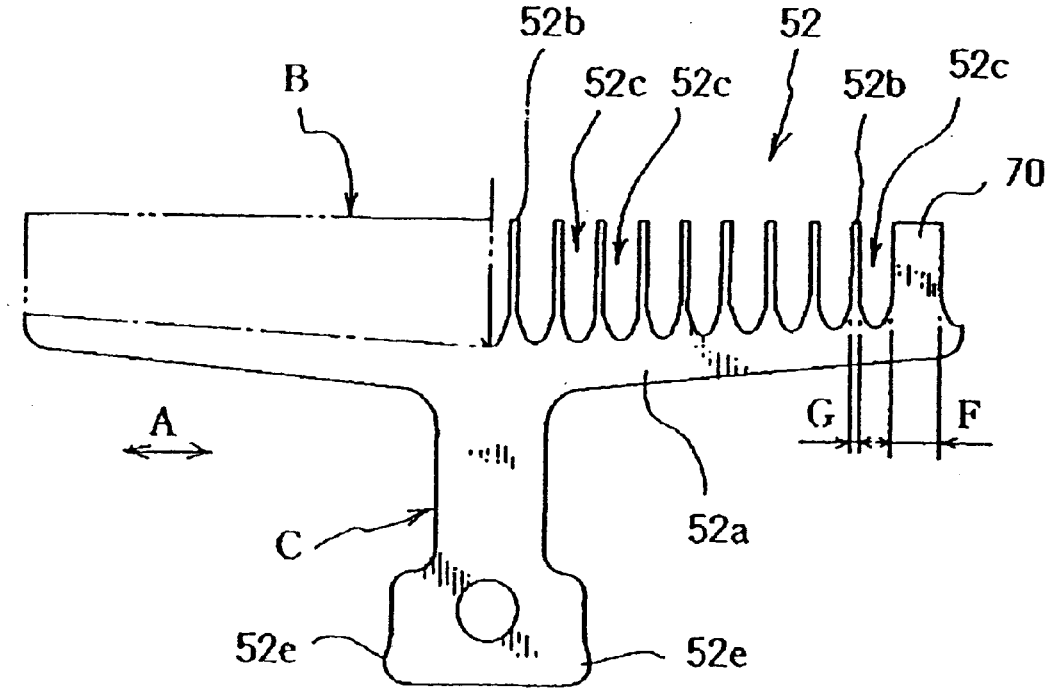
FIG. 5 is a front view which shows the structure of a second embodiment of the inner cutter for a reciprocating electric shaver according to the present invention.
Figure 6:
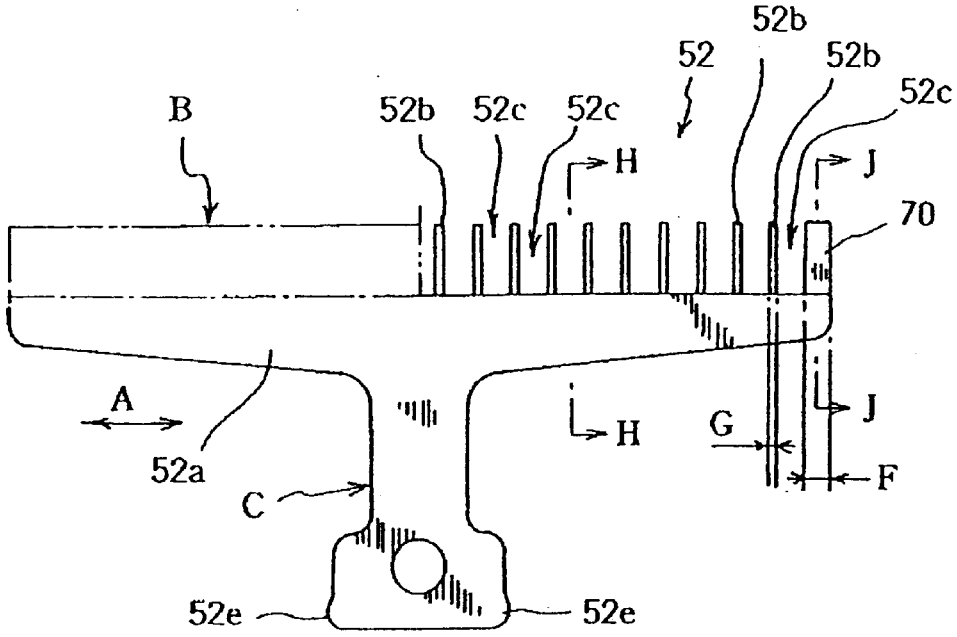
FIG. 6 is a front view which shows another example of the structure of the inner cutter for a reciprocating electric shaver according to the second embodiment.

The inner cutter 52 shown in FIG. 5 is comprised of: a pair of supporting wall sections 52*a* which are disposed so as to face each other; a plurality of small cutters 52*b* which are of an inverted U cross-sectional shape disposed between the upper ends of the supporting wall sections 52*a* and lined up side by side along the direction of length A of the supporting wall sections 52*a*; and connecting arches 70 which has the same cross-sectional shape as the small cutters 52*b* and are disposed between the pair of supporting wall sections 52*a*.

In other words, only the small cutters 52*b* and connecting arches 70 are present between the pair of supporting wall sections 52*a* of the inner cutter 52; and these connecting arches 70 are provided so as to maintain the strength of the connection between the pair of supporting wall sections 52*a*. When the inner cutter 52 is manufactured from a single metal plate, a plurality of slits 52*c* are, as in the same manufacturing methods as in the prior art and the first embodiment, formed at intervals in the bent portion B of the metal plate that is formed by bending, so that the thin parts with an inverted U shape that remain in the bent portion B, after the cutting, form the small cutters 52*b*; and at the same time, the interval F between some of the slits 52*c*,preferably the interval F between both ends of the bent portion B and the slits 52*c* located closest to such ends, is formed larger than the thickness G of the small cutters 52*b*, so that these thick areas form the connecting arches 70.

In the above embodiment, one connecting arch 70 is installed at each end of the row of small cutters 52*b*. However, when greater strength is desired in the inner cutter 52, connecting arches 70 may be formed between the small cutters 52*b*, thus forming the connecting arches 70 in greater numbers.

The pair of extended portions C outside the bent portion B of the metal plate are formed as a pair of supporting wall sections 52*a* that face each other as in the first embodiment.

In this structure, the connecting arches 70 which have a greater rigidity than the small cutters 52*b* are disposed between the pair of supporting wall sections 52*a* in addition to the small cutters 52*b*. Accordingly, the inner cutter 52 has an increased strength compared to a case in which only the small cutters 52 are so disposed.

The supporting wall sections 52*a* of the inner cutter 52 can be obtained by molding, using a synthetic resin material.

Figure 7:
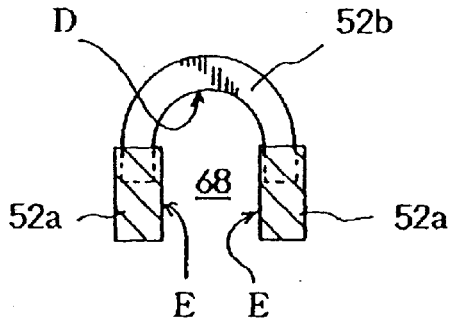
FIG. 7 is an arrow view taken along the line H—H in FIG. 6, which indicates an attachment structure that attaches the small cutters to the supporting wall sections.
Figure 8:
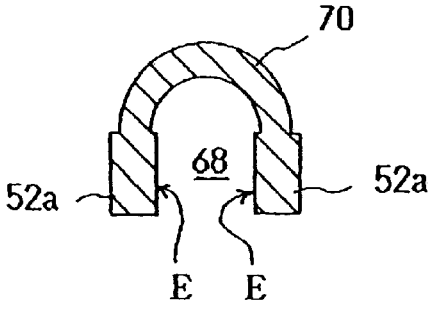
FIG. 8 is an arrow view taken along the line J—J in FIG. 6, which indicates a connecting structure that connects the connecting arches and the supporting wall sections.

In this manufacturing method, the pair of supporting wall sections 52*a* and the connecting arches 70 are integrally molded with a synthetic resin material, after which the small cutters 52*b* are securely attached to the supporting wall sections 52*a* by insert molding as shown in FIGS. 6 through 8. FIG. 7 is a sectional view taken along the line H—H in FIG. 6, showing that both end portions of each small cutter 52*b* which is formed in an arc shape (inverted U shape) are embedded in the upper end portions of the supporting wall sections 52*a* formed from a synthetic resin material. FIG. 8 is a sectional view taken along the line J—J in FIG. 6, showing the cross-sectional shape of the connecting arches 70. It is seen that this shape is substantially the same as the cross-sectional shape of the small cutters 52*b*.

It is necessary that the outer surfaces of the small cutters 52*b* are moved in contact with the inner surface of the outer cutter 12. Accordingly, a cross-sectional shape in which the outer surfaces of the connecting arches 70 protrude beyond the outer surfaces of the small cutters 52*b* is not allowed. As a result, the term "substantially the same cross-sectional shape" referred to above naturally includes cases in which the cross-sectional shape of the connecting arches 70 is the same as the cross-sectional shape of the small cutters 52*b*. In addition, this term also includes cross-sectional shapes in which the outer surfaces of the connecting arches 70 are located further inward than the outer surfaces of the small cutters 52*b* and are formed substantially in the shape of an inverted U even if the cross-sectional shapes are not exactly the same.

Accordingly, as in the first embodiment, the inner cutter 52 as a whole is formed in an inverted U cross-sectional shape as shown in FIG. 3 when viewed from the side (i. e., from the direction of one of the end portions of the bent portion B). Consequently, when whiskers are cleaned away by a brush, the brush is moved through the internal space 68 of the inner cutter 52, and whiskers adhering to the inner surface of the inner cutter 52, i. e., the inner surfaces D of the small cutters 52*b* and the facing inner surfaces E of the pair of supporting wall sections 52*a*,can be easily and reliably cleaned away.

Next, the linking structure between the inner cutter 52 and the driving mechanism 28 in the above-described first and second embodiments will be described with reference to FIGS. 9 through 11.

Since the pair of supporting wall sections 52*a* of the inner cutter 52 of the present invention are not connected to each other except by the small cutters 52*b* and connecting arches 70 formed in the bent portion B, both of the supporting wall sections 52*a* need to be linked to the driving mechanism 28.

Accordingly, projecting areas 52*e* are formed on both side surfaces of the end portions (lower end portions in FIGS. 2, 5 and 6) of supporting wall sections 52*a* of the inner cutter 52 so as to be located on the side of the driving mechanism 28, and these end portions are formed in an inverted T shape.

Figure 9:
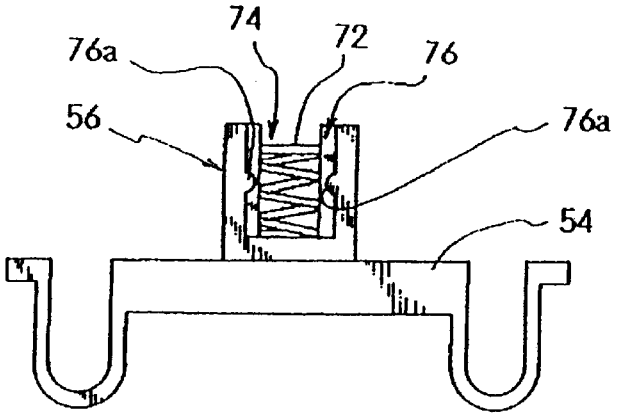
FIG. 9 is a front view which shows the structure of the vibrator and connecting base that constitute a part of the inner cutter driving mechanism.
Figure 10:
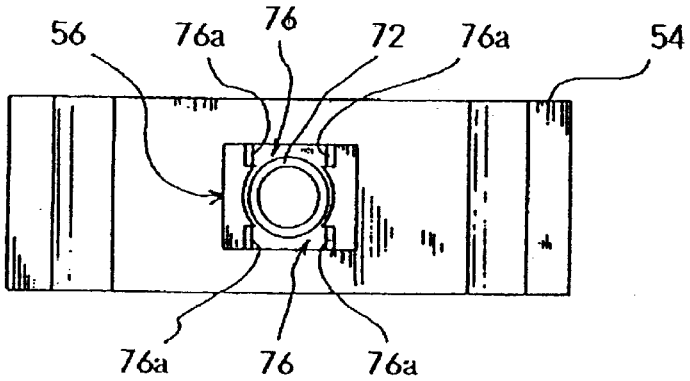
FIG. 10 is a plan view of FIG. 9.
Figure 11:
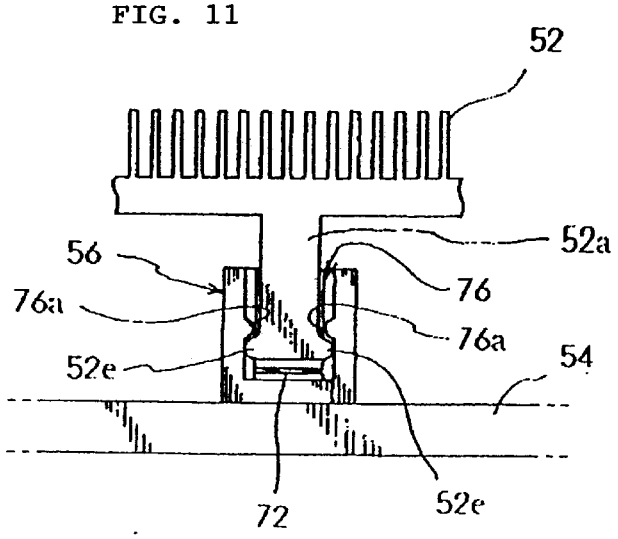
FIG. 11 is a front view of the essential portion in the connected state of the inner cutter in FIG. 9.

Meanwhile, as shown in FIGS. 9 and 10, a connecting base 56 which is to be connected to the inverted-T-shaped end portions of the pair of supporting wall sections 52*a* is provided on the upper surface of the vibrator 54 which forms a part of the driving mechanism 28. This connecting base 56 is in the shape of a rectangular parallelepiped, and a cylindrical recess 74 in which a coil spring 72 is installed from above is formed in the central portion of the connecting base 56, and also grooves 76 which extend upward and downward so as to allow the insertion of the inverted-T-shaped end portions of the pair of supporting wall sections 52*a* are formed in both side surfaces so that the grooves 76 are located on either side of the cylindrical recess 74. Furthermore, connecting projections 76*a* which engage with the projecting areas 52*e* on both side surfaces of the end portions of the supporting wall sections 52*a* are formed on the facing side surfaces running upward and downward inside the respective grooves 76.

Moreover, the spacing of the respective grooves 76 is set to be narrower than the diameter of the coil spring 72 so that it matches the spacing of the supporting wall sections 52*a* of the inner cutter 52. Accordingly, the respective grooves 76 communicate with the cylindrical recess 74, and portions of the coil spring 72 mounted in the cylindrical recess 74 protrude into the respective grooves 76.

When linking the inner cutter 52 to the driving mechanism 28, the inverted-T-shaped lower end portions of the supporting wall sections 52*a* located on the side of the driving mechanism 28 are first inserted into the respective grooves 76 of the connecting base 56, and the inner cutter 52 is pushed toward the connecting base 56.

In this case, the lower end portions of the supporting wall sections 52*a* contact a part of the coil spring 72 mounted in the connecting base 56. However, these lower end portions are pushed inward while compressing the coil spring 72, so that the projecting areas 52*e* ride over the connecting projections 76*a* and are caused to move further downward. As a result, the projecting areas 52*e* engage with the connecting projections 76*a* as shown in FIG. 11, so that the inner cutter 52 is connected to the connecting base 56. In this state, the inner cutter 52 is constantly urged upward by the coil spring 72. Accordingly, even when the inner cutter 52 is caused to perform a reciprocating motion by the driving mechanism 28, there is no play in the vertical direction. Furthermore, even in cases where a downward pressing force is applied from the skin via the outer cutter 12 during shaving, the inner cutter 52 can absorb this pressing force by being moved downward, and a tight fit against the skin is also maintained.

The inner cutter 52 can be removed easily from the connecting base 56. The inner cutter 52 is pulled in the direction which separates the inner cutter 52 from the connecting base 56, so that the engagement between the projecting areas 52*e* and connecting projections 76*a* is released.

Figure 12:
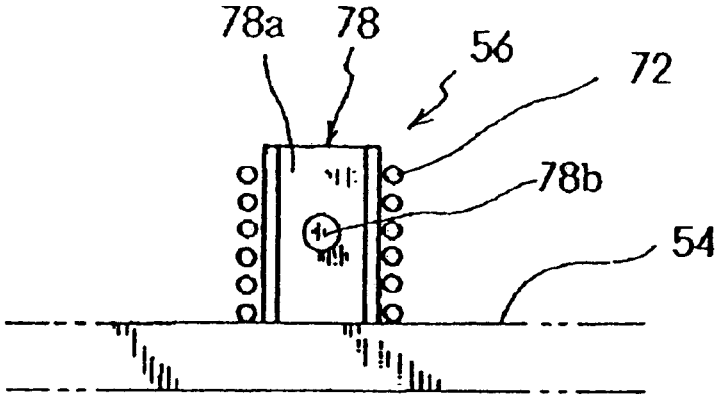
FIG. 12 is a front view which shows a different structure of the vibrator and connecting base that constitute a part of the driving mechs of the inner cutter.
Figure 13:
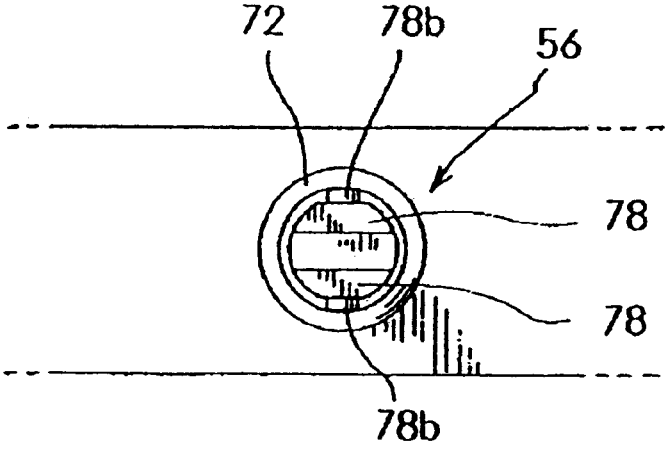
FIG. 13 is a plan view of FIG. 12.
Figure 14:
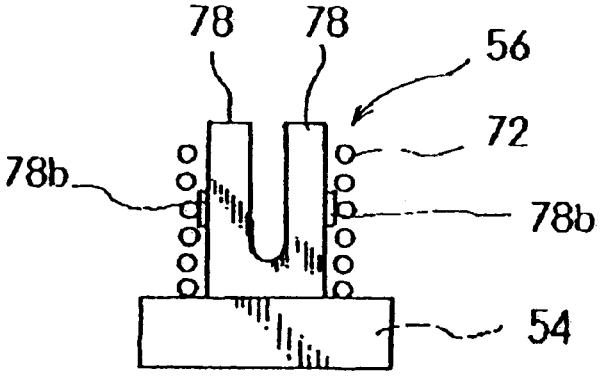
FIG. 14 is a side view of FIG. 12.

The structure shown in FIGS. 12 through 14 may be employed as for the connecting base 56.

The connecting base 56 is comprised of: two elastic members 78 which are disposed upright with a specified interval in between so that the spacing of the outside surfaces 78*a* matches the spacing of the facing inner surfaces of the supporting wall sections 52*a* of the inner cutter 52; connecting projections 78*b* which protrude laterally at intermediate points of the outside surfaces 78*a* of both elastic members 78; and a coil spring 72 which is fitted over the respective connecting projections 78*b* and the two elastic members 78. The two elastic members 78 may be formed by cutting a specified distance downward into the center of a columnar body from the upper surface as in the present embodiment, or the elastic members 78 can be directly installed upright on the connecting base 56.

Figure 15:
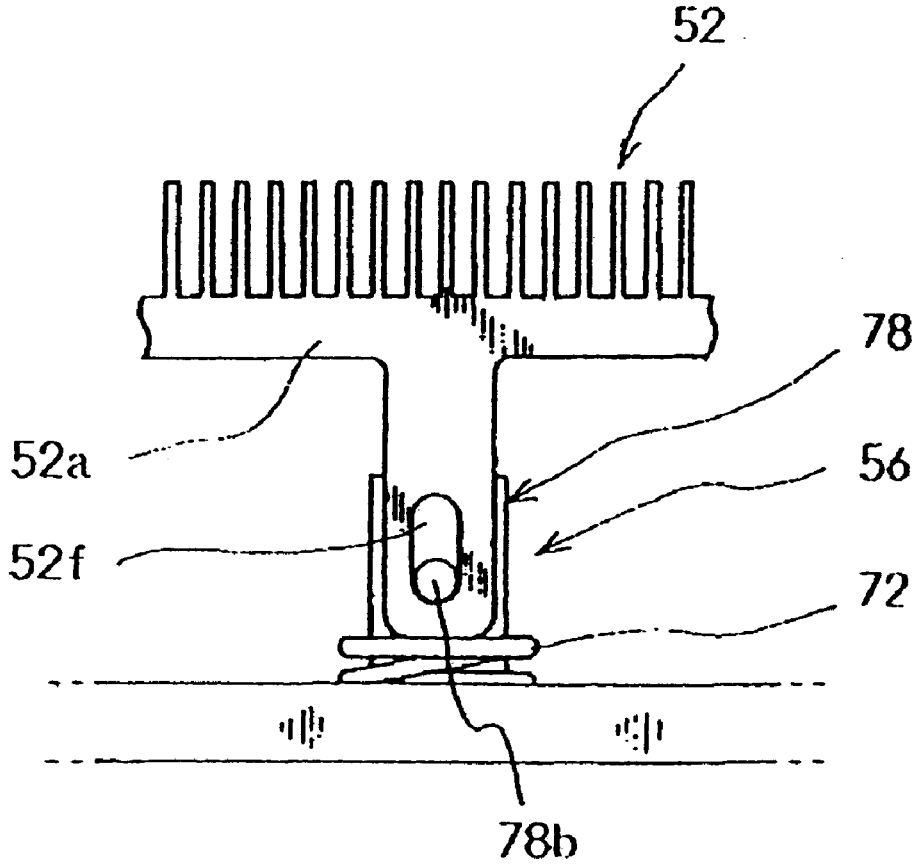
FIG. 15 is a front view of the essential portions in the connected state of the inner cutter in FIG. 12.

Slots 52*f* into which the connecting projections 78*b* are inserted are formed in the lower end portions of the supporting wall sections 52*a* of the inner cutter 52 (see FIG. 15).

The inner cutter 52 is attached to the connecting base 56 in the following manner:

The inner cutter 52 is pushed inward toward the connecting base 56 while the lower end portions of the supporting wall sections 52*a* are positioned so that their inner surfaces face the respective outside surfaces 78*a* of the two elastic members 78. In this case, the lower end portions of the supporting wall sections 52*a* contact the coil spring 72 mounted in the connecting base 56 but are pushed inward while compressing the coil spring 72.

Next, when the lower end portions of the supporting wall sections 52*a* contact the connecting projections 78*b*, the inner cutter 52 is pushed further downward so that the two elastic members 78 are pushed to tilt inward. As a result, the connecting projections 78*b* is moved toward the inner surfaces of the lower end portions of the supporting wall sections 52*a*; and when these connecting projections 78*b* reach the interiors of the slots 52*f*, the respective elastic members 78 return to their original positions as a result of their own elastic force. The connecting projections 78*b* are thus inserted into the slots 52*f*. As a result, the inner cutter 52 is connected to the connecting base 56.

When removing the inner cutter 52 from the connecting base 56, it is only necessary to pull the inner cutter 52 away from the connecting base 56 while applying a force. When the inner cutter 52 is thus pulled away, the connecting projections 78*b* contact the inner circumferential rims of the slots 52*f*. However, the respective elastic members 78 which receive a force from the connecting projections 78*b* tilt inward so that the connecting projections 78*b* are removed from the slots 52*f*.

Figure 16:
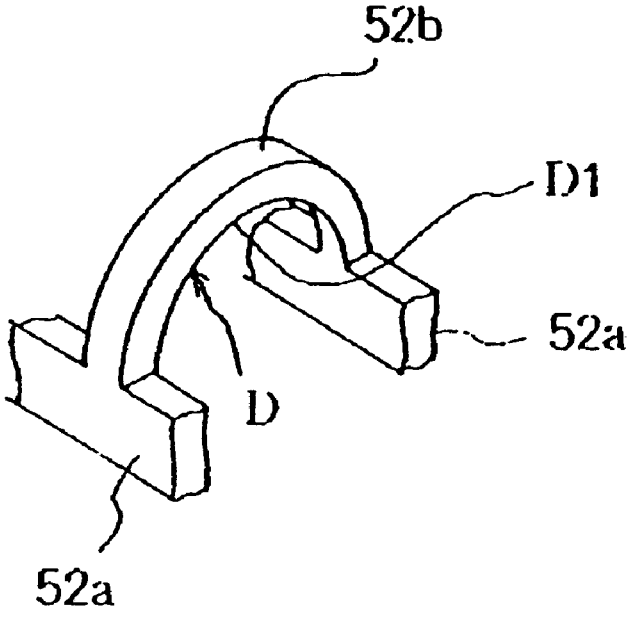
FIG. 16 is an enlarged perspective view of the essential portions in the corner portions of the inner surfaces of the small cutters of the inner cutter.

In the above-described inner cutter for a reciprocating electric shaver 52, the corners D1 of the inner surfaces D of the small cutters 52*b*, which do not contact the outer cutter 12 and have no connection with the shaving action of whiskers, are chamfered as shown in FIG. 16. As a result, if the brush should contact these corners during cleaning, the brush is not caught on the comers, and cleaning can be smoothly performed. This corner chamfering can be accomplished by pressing or discharge working.

Figure 17:
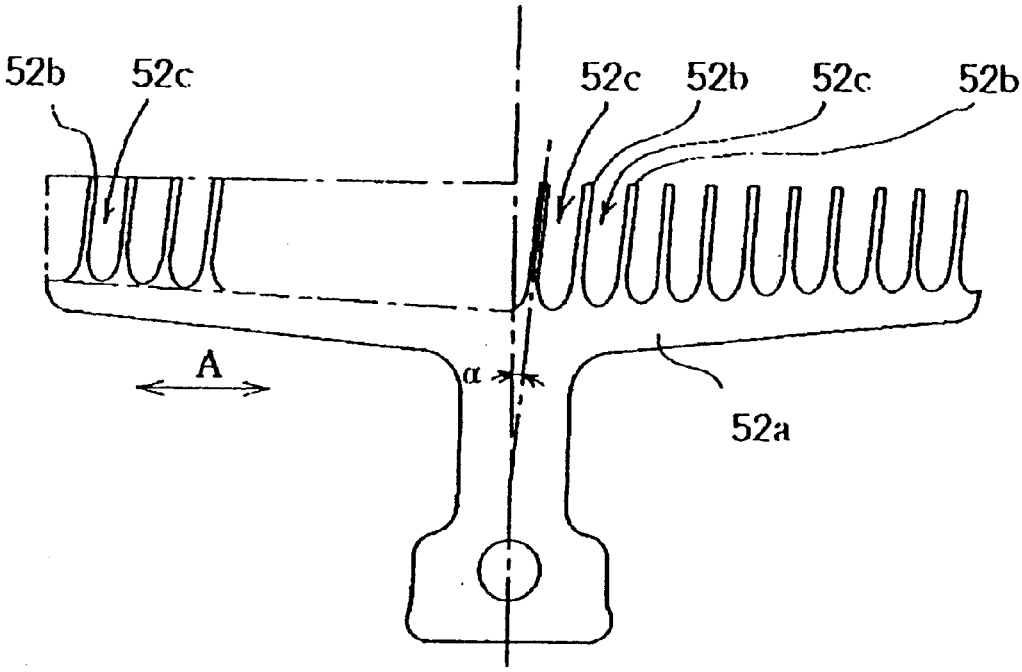
FIG. 17 is a front view showing the structure of another embodiment of the inner cutter for a reciprocating electric shaver according to the present invention.
Figure 18:
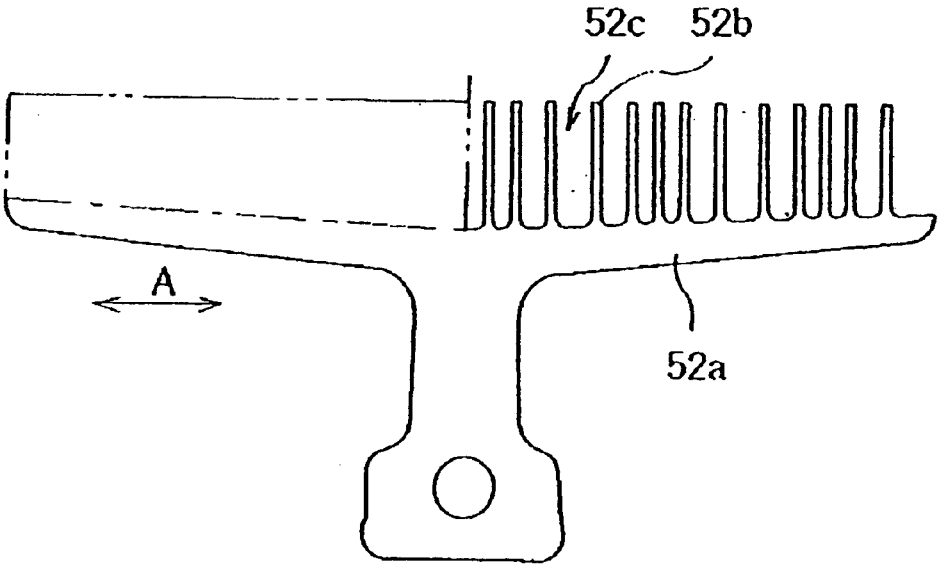
FIG. 18 is a front view showing the structure of another embodiment of the inner cutter for a reciprocating electric shaver according to the present invention.
Figure 19:
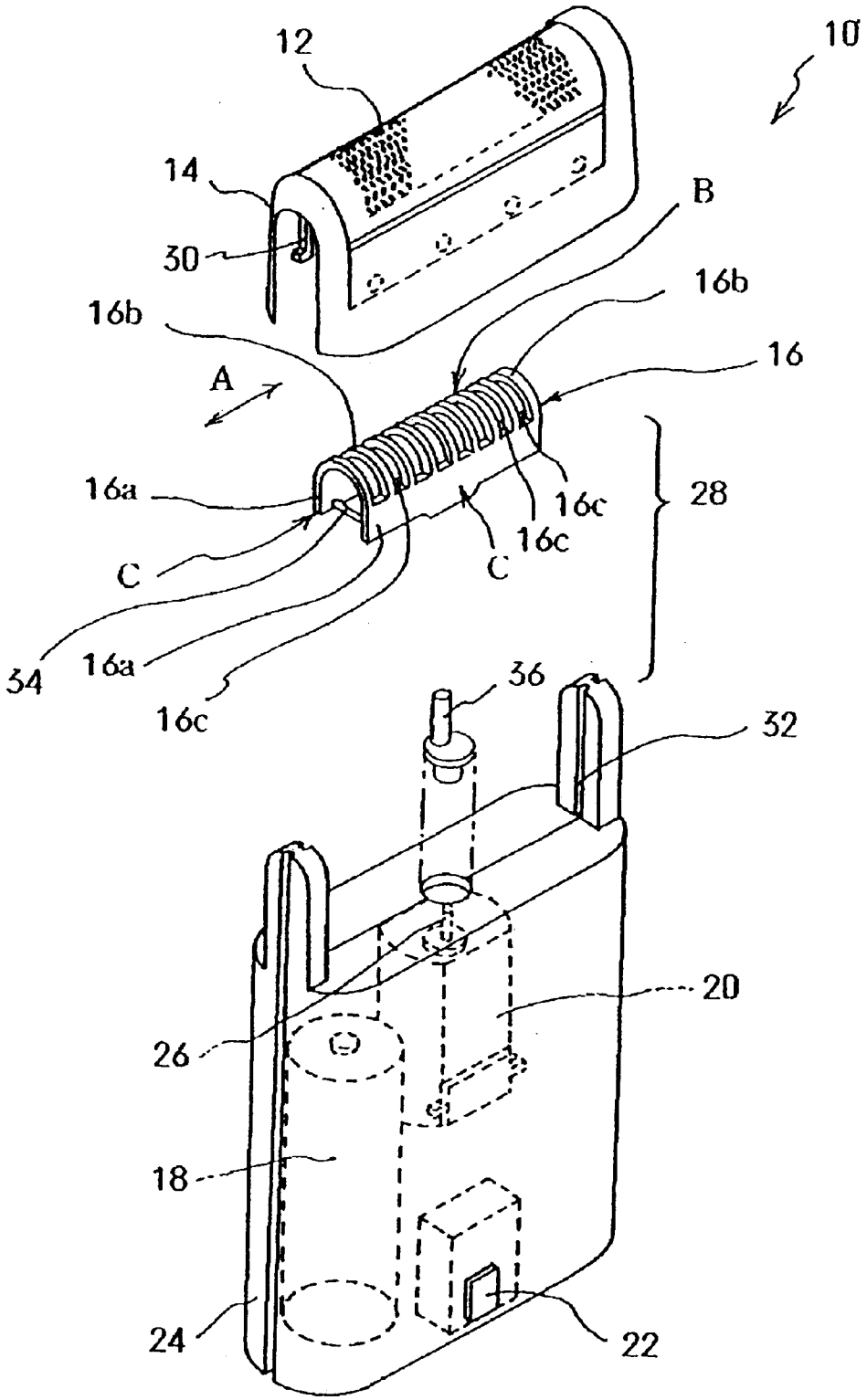
FIG. 19 is an exploded perspective view showing the structure of a reciprocating electric shaver which has a conventional inner cutter.
Figure 20:
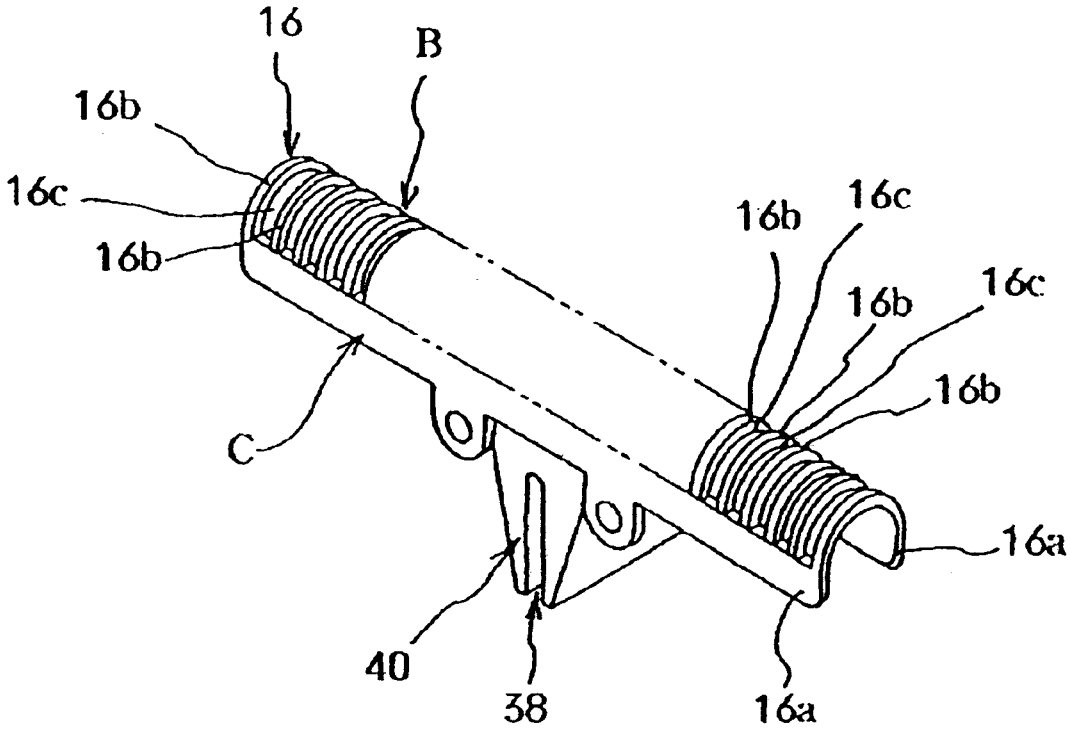
FIG. 20 is a perspective view showing the structure of another example of a conventional inner cutter.

The structure of the inner cutter of the present invention is not limited to the structures shown in FIGS. 2, 4, 5 and 6. For example, the present invention is applicable to an inner cutter in which the slits 52*c* are formed at an oblique angle, and the small cutters 52*b* are inclined by a specified angle of $\alpha$ with respect to the direction perpendicular to the direction of length A of the supporting wall sections 52*a*,as shown in FIG. 17. Furthermore, the present invention is further applicable to an inner cutter in which the spacing of the slits 52*c* varies along the direction of length A of the supporting wall sections 52*a*,so that the small cutters 52*b* are formed with a varied spacing as shown in FIG. 18.

Various preferred embodiments of the present invention are described above. However, the present invention is not limited to the embodiments described above. It goes without saying that numerous modifications may be made without departing from the spirit of the invention.

When the inner cutter according to the present invention as claimed in claim 1 or 2 is used in a reciprocating electric shaver, the following merit is obtained. When cleaning away, with a brush, whiskers adhering to the inner surface of the inner cutter, i. e., the inner surfaces of the small cutters and the facing inner surfaces of the supporting wall sections, such cleaning is difficult in conventional cutters because the connecting pins and connecting block form obstacles between the pair of supporting wall sections and interfere with the movement of the brush. However, in the present invention, since only the small cutters are disposed between the supporting wall sections and the inner cutter is formed in an inverted U as a whole, whiskers adhering to the inner surface of the inner cutter can be continuously cleaned away from one end of the inner cutter to the other while the brush is moved through the internal space of the inner cutter. Accordingly, cleaning can be performed in a simple and reliable manner.

Furthermore, when the inner cutter according to the present invention as claimed in claim 3 or 4 is used in a reciprocating electric shaver, the following merits are obtained. Since only connecting arches which have the same cross-sectional shape as the small cutters are disposed between the supporting wall sections besides the small cutters, the brush can be moved through the internal space of the inner cutter, and whiskers adhering to the inner surface of the inner cutter can easily be cleaned away. In addition, since the connecting arches are disposed between the supporting wall sections, the inner cutter can have an overall increased strength compared to a case in which only the small cutters are so disposed.

Furthermore, when a reciprocating electric shaver equipped with one of the above inner cutters is used, the following merits are obtained. Since cleaning of the cutter can easily be performed, the user does not feel any resistance to the task of cleaning away the accumulated whiskers. Accordingly, cleaning of the electric shaver is frequently performed, and whiskers are shaved with the outer cutter and inner cutter in a clean state. Consequently, the sharpness and feeling of the electric shaver are improved, and the deterioration of the outer and inner cutters themselves is retarded.

What is claimed is:

1. A reciprocating electric shaver including a reciprocating means, a connecting member provided on said reciprocating means and an inner cutter detachably coupled to said connecting member, said inner cutter consisting of a pair of supporting wall sections that are disposed opposite and parallel to each other, small cutters that have an inverted U cross-sectional shape disposed between upper ends of said pair of supporting wall sections so that a plurality of said small cutters are disposed along a longitudinal direction of length of said pair of supporting wall sections and a mounting projection provided on each of said pair of supporting wall sections projecting in an opposite direction than said small cutters for detachably coupling said inner cutter to said connecting member, wherein said inner cutter is further characterized in that:

only said small cutters are disposed between said pair of supporting wall sections;

whereby said inner cutter is detachable from said connecting member for easy cleaning of inner and outer surfaces of said inner cutter.

2. The electric shaver according claim 1, characterized in that said pair of supporting wall sections consists of a pair of oppositely extended portions of a metal plate which is bent in two so as to form a bent portion that has an inverted U shape in cross section, and said small cutters consist of a plurality of slits that cut across a direction of length of said bent portion at intervals in said bent portion.

3. A reciprocating electric shaver including a reciprocating means, a connecting member coupled to said reciprocating means and an inner cutter detachably coupled to said connecting member, said inner cutter consisting of a pair of supporting wall sections that are disposed opposite and parallel to each other, small cutters that have an inverted U cross-sectional disposed between upper ends of said pair of supporting wall sections so that a plurality of said small cutters are disposed along a longitudinal direction of length of said pair of supporting wall sections and a mounting projection is provided on each of said supporting wall sections projecting in an opposite direction than said small cutters for detachably coupling said inner cutter to said connecting member, wherein said inner cutter is further characterized in that:

only said small cutters with said inverted U cross-sectional shape are disposed side by side between said pair of supporting wall sections;

whereby said inner cutter is detachably coupled from said connecting member for easy cleaning of inner and outer surfaces of said inner cutter.

4. The cutter for a reciprocating electric shaver according to claim 3, characterized in that said pair of supporting wall sections and said connecting arches are integrally molded using a synthetic resin material, and said small cutters are attached between said pair of supporting wall sections by insert molding.

5. The cutter for a reciprocating electric shaver according to claim 1, 2, 3 or 4, characterized in that corners of inner surfaces of said small cutters are chamfered.

6. A reciprocating electric shaver characterized in that said shaver is equipped with:

an inner cutter for a reciprocating electric shaver according to claim 1, 2, 3 or 4;

a mesh-form outer cutter which is bent in an inverted U cross-sectional shape so that an inner surface thereof contacts an outer surface of said inner cutter; and a driving mechanism which causes said inner cutter to perform a reciprocating motion relative to said mesh-form outer cutter along a direction of length of said supporting wall sections.

7. A reciprocating electric shaver characterized in that said shaver is equipped with:

an inner cuter for a reciprocating electric shaver according to claim 5;

a mesh-form outer cutter which is bent in an inverted U cross-sectional shape so that an inner surface thereof contacts an outer surface of said inner cutter; and a driving mechanism which causes said inner cutter to perform a reciprocating motion relative to said mesh-form outer cutter along a direction of length of said supporting wall sections.

8. A reciprocating electric having according to claim 1 wherein said connecting member comprises:

a rectangular parallel piped base coupled to said reciprocating means;

a cylindrical hole provided in a top surface of said base;

a coil spring provided inside said cylindrical hole;

a pair of grooves provided in parallel in and extending longitudinally of said base; and connecting projections provided in said pair of grooves;

whereby said mounting projection provided on each of said supporting wall sections is snap engaged with said base by said mounting projection extending into said groove.

9. A reciprocating electric shaver according to claim 1 wherein said connecting member comprises:

an upwardly extending base coupled to said reciprocating means;

a coil spring provided around said base; and connecting projections extending outwardly from said base;

whereby said mounting projection provided on each supporting wall is detachably coupled to said base via said connecting projections.

* * * * *